United States Patent [19]

Levinson et al.

[11] 4,196,002

[45] Apr. 1, 1980

[54] PHOTOTHERMOGRAPHIC ELEMENT CONTAINING HEAT SENSITIVE DYE MATERIALS

[75] Inventors: Steven R. Levinson; Anthony Adin, both of Rochester, N.Y.

[73] Assignee: Eastman Kodak Company, Rochester, N.Y.

[21] Appl. No.: 953,986

[22] Filed: Oct. 23, 1978

Related U.S. Application Data

[63] Continuation-in-part of Ser. No. 834,587, Sep. 19, 1977, abandoned.

[51] Int. Cl.[2] ..... G03C 1/84

[52] U.S. Cl. ..... 430/617; 430/350

[58] Field of Search ..... 96/114.1, 66 T, 84 R

[56] References Cited

U.S. PATENT DOCUMENTS

| | | | |
|---|---|---|---|
| 1,770,534 | 11/1956 | Marx | 41/41 |
| 3,050,393 | 8/1967 | MacDonald | 96/84 |
| 3,094,417 | 6/1963 | Workman | 96/28 |
| 3,222,986 | 12/1965 | Altman | 88/24 |
| 3,227,556 | 1/1966 | Oliver et al. | 96/109 |
| 3,390,994 | 7/1968 | Cescon | 96/48 |
| 3,390,997 | 7/1968 | Read | 96/48 |
| 3,457,075 | 7/1969 | Morgan et al. | 96/114.1 |
| 3,769,019 | 10/1973 | Weise et al. | 96/114.1 |
| 4,002,479 | 1/1977 | Suzuki et al. | 96/114.1 |
| 4,009,039 | 2/1977 | Masuda et al. | 96/114.1 |

OTHER PUBLICATIONS

Research Disclosure, Oct 1974, Item 12617, pp. 12–30.
Nineham, Chem. Reviews, vol. 55, 1955, pp. 355–369.

*Primary Examiner*—Jack P. Brammer
*Attorney, Agent, or Firm*—Richard E. Knapp

[57] ABSTRACT

A photothermographic element can comprise a support and on the support or in the support an antihalation or filter component that comprises a heat bleachable material comprising (i) at least one hexaarylbiimidazole with (ii) at least one dye, especially an antihalation or filter dye, that is reactive with the product of the hexaarylbiimidazole formed upon heating the material to a temperature above about 90° C. This provides an antihalation or filter material that becomes at least 40% colorless within about 20 minutes, typically within about 30 seconds, upon heating to a temperature as described. The antihalation or filter material can be a heat bleachable dye layer of a photothermographic element.

36 Claims, No Drawings

PHOTOTHERMOGRAPHIC ELEMENT CONTAINING HEAT SENSITIVE DYE MATERIALS

This is a continuation-in-part application of U.S. Ser. No. 834,587 of Steven R. Levinson and Anthony Adin, filed Sept. 19, 1977 now abandoned.

BACKGROUND OF THE INVENTION

1. Field of the Invention

The present invention relates to a photothermographic element having at least one layer that changes its electromagnetic absorption characteristics upon application of heat. This layer is useful, for example, as a filter layer or an antihalation layer in a photothermographic element.

2. State of the Art

A variety of photographic materials are known which can be processed by immersion in various processing solutions or baths. It is well known to provide different filter layers, including filter overcoat layers, filter interlayers and antihalation layers in such elements to provide improved photographic reproduction. The filtering capability or antihalation capability of these layers is generally removed during processing of these elements by one of the processing solutions or baths. This provides a processed element that is transparent to the desired region of the electromagnetic spectrum, typically the visible region.

Imaging elements are also known which can be processed, after imagewise exposure, simply by heating the element. These elements include known heat developable photographic elements, also known as photothermographic elements. It is desirable that heat developable elements, such as heat developable photographic films, have an antihalation layer or filter layer, especially to provide improved microimaging capability. In most cases, these filter layers or antihalation layers must be rendered substantially transparent upon heat processing in order to avoid use of processing baths or solutions.

The antihalation layer of a photographic element helps to prevent light that has passed through the radiation sensitive layer from reflecting back into the light sensitive layer. If this undesirable reflection is not prevented, the reflected light can reduce the sharpness of the resulting image. Antihalation layers, and filter layers, have been suggested for use with heat developable photographic elements.

Antihalation layers in heat developable materials are known which change from colored to colorless on exposure to heat or light. No separate activating component is used in such an antihalation layer. The dyes described provide antihalation protection; however, the dyes generally require higher temperatures than desired before they change from colored to colorless. Another antihalation layer is known in a heat developable photographic element that contains an acid component of a dye which is neutralized by a heat generated base. This is described, for instance, in U.S. Pat. No. 3,769,019 of Wiese et al. Decolorization of the described dye takes place by removal of an acid portion by heat. A problem with this antihalation material is that the decolorized form of the dye is not always as permanent as desired. The decolorized form changes back to a colored form which adversely affects the developed image. This can occur within an undesirably short period of time.

Photobleachable antihalation layers containing dyes that are photobleachable are also known. It is often disadvantageous, however, to have a photosensitive antihalation layer, as a post-process light bleaching step is needed, an additional processing operation.

Antihalation layers have also been used both for vesicular and diazo imaging films. These films, however, involve exposure of the antihalation layer to light to inactivate the material and do not use heat to bleach the antihalation layer.

Typically, layers that can be useful as antihalation layers, or filter layers, in a photothermographic element, can also be useful alone on a support to provide an element that is useful for thermographic imaging purposes. That is, the element can be imagewise heated to provide heat bleaching in the imagewise exposed areas. In this method of imaging any color change can be useful to form an image. For example, a substantially colorless dye precursor can be imagewise heated to form a colored image. A colored dye can also be imagewise thermally exposed to form a colorless material to provide an image. A variety of theromographic materials are known that can use this concept. Brief imagewise heating of the element causes migration of the reactants which results in decolorization in the imagewise heated area. Many thermographic elements are also useful for making reflex copies, writing with a heated stylus or imagewise exposure with a laser. Imagewise changing of a formazan dye from colored to colorless with a reducing agent is also known. This is described, for example, in *Research Disclosure,* October 1974, Item 12617, pages 12–30, published by Industrial Opportunities Ltd., Homewell, Havant, Hampshire, PO9 1EF, UK. There has been a continuing need, however, to provide new and improved combinations of materials for thermographic imaging with dyes. This need has been especially true for materials which are more permanently changed in color to provide more stable images.

A variety of hexaarylbiimidazole compounds are known in the imaging elements in which a colorless compound is photolytically changed to a colored compound in the imagewise exposed areas. Imaging materials which embody hexaarylbiimidazole compounds are known which involve what is described as a free radical imaging mechanism such as described in U.S. Pat. No. 3,390,994 of Cescon, issued July 2, 1968. Formation of a colorless layer is not described for a heat developable photographic element comprising a formazan dye with a hexaarylbiimidazole compound.

Each of the described elements having a heat bleachable layer, especially the photothermographic elements containing a heat bleachable filter or antihalation layer, have at least one of the disadvantages: (1) undesirably high temperatures are required to bleach the layer; (2) in many cases even when the dye is bleached it is not adequately stable and has a tendency to form undesired stain or discoloration on prolonged post process keeping; and (3) the choice of suitable dyes is undesirably limited for antihalation and filter layer purposes. A need has also existed for antihalation layers that provide a desired color for use in photothermographic films.

SUMMARY OF THE INVENTION

It has been found according to the invention that the described improvements are provided in a photothermographic element comprising (a) a support having thereon (b) a photosensitive component and, in the support or on the support, (c) an antihalation or filter component that comprises, in reactive association, (i) at least one hexaarylbiimidazole, as described herein, with (ii) at least one antihalation or filter dye that is reactive with the product of the described hexaarylbiimidazole formed upon heating to a temperature of at least about 90° C., and wherein the antihalation or filter component becomes at least 40%, preferably at least 90%, colorless within about 20 minutes, typically within about 0.5 minutes, upon heating to a temperature of at least about 90° C. The described antihalation or filter component is especially advantageous because of the post-processing stability of the component, the speed with which the layer becomes at least 40% colorless upon heating, and good shelf life storage stability.

These advantages are especially apparent in a photothermographic element according to the invention comprising (a) a support, especially a transparent film support having thereon, (b) at least one photosensitive layer and, in the support or on the support, (c) at least one antihalation component comprising, in reactive association, (i) at least one hexaarylbiimidazole with (ii) at least one formazan antihalation dye, wherein the antihalation component becomes at least about 40%, and preferably at least 90%, colorless within about 20 minutes upon heating to a temperature of at least about 90° C.

The colored heat bleachable material according to the invention is useful in a variety of ways to provide improved imaging in a photothermographic element.

DETAILED DESCRIPTION OF THE INVENTION

A variety of hexaarylbiimidazole compounds are useful in an antihalation or filter component according to the invention. These hexaarylbiimidazole compounds also described herein as oxidative arylimidazoyl dimers, are known compounds and can be prepared by methods known in the art. For instance, hexaarylbiimidazoles can be prepared by means of an interfacial oxidation of the parent triarylimidazole using potassium ferricyanide as an oxidant. Typical hexaarylbiimidazole compounds that are useful according to the invention are described, for example, in and can be selected from the following patents: U.S. Pat. Nos. 3,734,733 of Poot et al, issued May 22, 1973; 3,390,997 of Read, issued July 2, 1968; 3,383,212 of MacLachlan, issued May 14, 1968; 3,445,234 of Cescon et al, issued May 20, 1969; 3,395,018 of Read, issued July 30, 1968; 3,390,994 of Cescon et al, issued July 2, 1968; 3,615,481 of Looney, issued Oct. 26, 1971; 3,666,466 of Strilko, issued May 30, 1972; 3,630,736 of Cescon, issued Dec. 28, 1971; and 3,533,797 of James et al, issued Oct. 13, 1970. These patents are incorporated herein by reference.

Typical examples of useful hexaarylbiimidazole compounds include oxidative 2,4,5-triarylimidazolyl dimers in which the aryl groups are selected from p-isopropylphenyl, p-methoxyphenyl, p-n-butylphenyl, p-methylphenyl, and p-ethylphenyl.

An especially useful compound is an oxidative arylimidazoyl dimer of a compound represented by the formula:

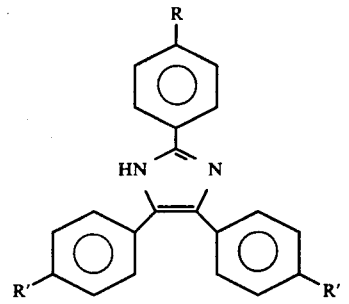

(I)

wherein R and R' are alkyl containing 1 to 4 carbon atoms, such as methyl, ethyl, propyl and butyl, or hydrogen.

If desired, a combination of hexaarylbiimidazole compounds can be useful. An example of such a combination is the combination of compounds, within structure (I), (a) wherein R and R' are hydrogen with (b) wherein R and R' are isopropyl.

Selection of an optimum hexaarylbiimidazole compound or combination of such compounds will depend upon such factors as the particular antihalation or filter dye or dyes to be used, processing conditions, desired degree of bleaching in the layer containing the dye or dyes, solubility characteristics of the components and the like.

A variety of dyes and dye precursors can be useful according to the invention with the described hexaarylbiimidazole compounds. Any dye or dye precursor can be used according to the invention which changes its color, i.e. changes its electromagnetic radiation absorption characteristics, upon reaction with what are believed to be free radicals provided upon heating the described hexaarylbiimidazole compounds. For antihalation layer purposes for example, it is desirable that the heat bleachable layer have substantially uniform absorption in the spectrum region in which the imaging composition is sensitive. The antihalation dye or dye precursor should also be changed to the extent that at least about 40%, and preferably at least 90%, of the layer is changed from colored to colorless or the layer has substantially no optical density.

A variety of dyes are known which can be bleached or converted to a colorless form. Formazan dyes and azo dyes are examples of dyes that are useful.

Especially useful antihalation dyes are formazan dyes. Useful formazan dyes are represented, for example, by the structure:

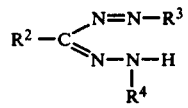

formazan dye wherein $R^2$ is alkyl or aryl, such as methyl, ethyl, hexyl or phenyl, p-nitrophenyl, and dimethoxyphenyl;

$R^3$ is aryl, preferably phenyl, including substituted phenyl, such as p-nitrophenyl, p-methoxyphenyl and anthraquinonyl; and $R^4$ is aryl, preferably phenyl, including substituted phenyl, such as p-nitrophenyl, p-methoxyphenyl and anthraquinonyl.

The terms "alkyl" and "aryl" are intended herein to include unsubstituted alkyl and unsubstituted aryl as well as alkyl and aryl that are substituted with groups that do not adversely affect the desired properties of the described antihalation and filter component. Suitable substituents include, for example, p-nitro as in p-nitrophenyl and p-methoxy as in p-methoxyphenyl.

Especially useful formazan dyes include, for instance:

1. 1,3,5-triphenylformazan
2. 1-(4-chlorophenyl)-3,5-diphenylformazan
3. 1-p-nitrophenyl-3,5-(diphenyl)formazan
4. 1,5-diphenyl-3-methylformazan
5. 1,5-diphenyl-3-(3-iodophenylf)formazan
6. 1,5-diphenyl-3-(2-naphthyl)formazan
7. 1-(2-carboxyphenyl)-3,5-diphenylformazan and
8. 1,5-diphenyl-3-(p-nitrophenyl)formazan.

A very useful formazan dye is 1,5-diphenyl-3-(p-nitrophenyl)formazan represented by the formula:

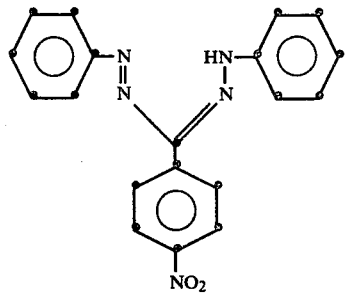

The described formazan antihalation or filter dyes that are useful according to the invention can be a metallized formazan dye. Examples of useful metallized formazan dyes are zinc-formazan dye complexes, cobalt-formazan dye complexes, copper-formazan dye complexes, cadmium-formazan dye complexes and nickel-formazan dye complexes. Combinations of metallized formazan dyes can also be useful. Metallized formazan dyes can also be useful in combination with formazan dyes that are not metallized. An especially useful metallized formazan dye is a zinc-formazan dye complex consisting essentially of a complex of zinc chloride with a formazan dye represented by the structure:

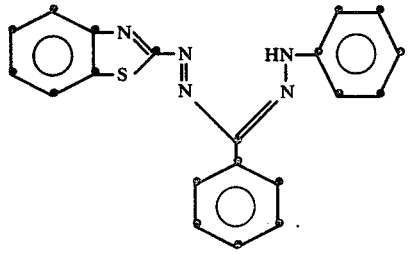

Another useful metallized formazan dye is a cobalt-formazan dye complex consisting essentially of a complex of cobaltous nitrate with a formazan dye as described. A further useful metallized formazan dye is a copper-formazan dye complex consisting essentially of a complex of cupric acetate with a formazan dye as described. The metallized formazan dye complexes can be prepared by methods known in the chemical arts.

Other useful formazan dyes are described, for example, in *Research Disclosure,* October 1974, Item 12617, pages 12–30, published by Industrial Opportunities Ltd., Homewell, Havant, Hampshire, PO9 1EF, UK. U.S. Pat. No. 3,227,556 of Oliver and Gates, issued Jan. 4, 1966; U.S. Pat. No. 3,050,393 of Macdonald, issued Aug. 21, 1962; and *Chemical Reviews,* 1955, beginning at page 356. These are incorporated herein by reference.

Combinations of formazan dyes can be especially useful to provide the desired degree of absorption. An example of a combination of formazan dyes is triphenylformazan with 1-(p-nitrophenyl)-3-methyl-5-phenylformazan.

The formazan dyes and their preparation are known in the art. The formazan dyes can be prepared by procedures known in the art, such as described in *Chemical Reviews,* 1955, beginning at page 356.

The coverages and proportions of the components which comprise the described antihalation or filter component of the present invention can vary over wide ranges depending upon such factors as the particular use, location in the element of the antihalation or filter component, the desired degree of absorption, processing temperatures and the like. For example, in some photothermographic elements the concentration of dye is sufficient to provide an optical density of at least about 0.05. For antihalation purposes, it is desirable that the concentration of the dye be sufficient to provide an optical density of at least about 0.2 such as about 0.3 to about 0.8. The hexaarylbiimidazole must be present in at least sufficient concentration to provide at least 40% bleaching of the described dye. With formazan dyes, for example, a useful concentration is within the range of 0.2 to 10 moles of the hexaarylbiimidazole to 1 mole of formazan dye. Typically, an excess of the hexaarylbiimidazole compound insures the desired degree of reaction with the described dye in the elements in which the dye is used. The preferred molar ratio of hexaarylbiimidazole compound to dye is within the range of about 0.4 to about 3.0 with an especially useful ratio being about 1.0 to 1.5. The exact mechanism by which the described dye and dye-containing layer change from colored to colorless is not completely understood. However, it is believed that the hexaarylbiimidazole compound upon heating forms radicals which react with the dye in a manner which changes the dye structure from colored to a less highly colored material. This reaction is believed to significantly contribute to the surprising stability of the colorless layer after heating.

The elements according to the invention can contain various colloids and polymers alone or in combination as vehicles, binding agents and in various layers. Suitable materials as described are hydrophilic materials or hydrophobic materials. The colloids and polymers are transparent or translucent and include those materials which do not adversely affect the reaction which changes the dye from colored to colorless and which can withstand the processing temperatures employed. These colloids and polymers include, for example, proteins such as gelatin, gelatin derivatives, cellulose derivatives, polysaccharides such as dextran and the like; and synthetic polymeric substances such as water soluble polyvinyl compounds like poly(vinyl pyrrolidone), acrylamide polymers and the like. Other synthetic polymeric compounds which can be useful include dispersed vinyl compounds such as in latex form. Effective polymers include high molecular weight materials, polymers and resins which are compatible with the imaging materials of the element. When a formazan dye is used with a hexaarylbiimidazole for antihalation purposes, especially useful binders are polysulfonamide binders and poly(methyl methacrylate) binders. One useful polysulfonamide binder is a poly(ethylene-co-1,4-cyclohexylenedimethylene-1-methyl-2,4-benzene disulfonamide) binder. Combinations of the described colloids and polymers can also be useful if desired. Also, water insoluble polymers, such as poly(vinyl butyral), such as BUTVAR B-76, a trade name product available from the Monsanto Company, U.S.A., poly(methyl methacrylate) and latexes which are compatible with the antihalation or filter compounds are useful.

The antihalation layer as described can be useful in a variety of photothermographic elements. Useful photothermographic elements include those which are designed to provide an image from photographic silver halide, such as color images, or elements designed for non-silver imaging. Photothermographic elements which are designed for microimaging are especially useful with the antihalation materials according to the invention.

The described combination of the hexaarylbiimidazole compound and dye, especially the formazan dye, can be in any suitable location in the photothermographic element which provides the desired bleaching of the dye upon heating. Other of the described components of the photothermographic element according to the invention can be any suitable location in the element which provides the desired image. For example, if desired, one or more components of the imaging element according to the invention can be in one or more layers of the element. In some cases, it can be desirable to include certain percentages of the described reducing agents, image stabilizer or stabilizer precursors, dyes and/or other addenda in a protective layer over the heat developable element. In some cases this can reduce migration of certain addenda between the layers of the described element.

It is necessary that the image-forming components in the photothermographic element according to the invention be in reactive association with each other in order to provide the desired image. It is also necessary that the described dye and hexaarylbiimidazole compound be in reactive association with one another to provide the desired heat bleaching in the antihalation or filter component. The term "in reactive association" as employed herein is intended to mean that the described materials are in a location with respect to each other which enables the desired processing and heat bleaching and provides a more useful developed image. The term is also employed herein to mean that the hexaarylbiimidazole compound and the dye are in a location with respect to each other which enables the desired change of the dye from colored to colorless upon heating as described. For example, one of the components can be in one layer of an imaging element and other components in one or more other layers with the provision that they are in reactive association.

The photothermographic element according to the invention comprises a photosensitive component which can be a silver photosensitive component or non-silver photosensitive component. When a silver photosensitive component is used, photosensitive silver halide is especially useful due to its degree of photosensitivity compared to other photographic components. A typical concentration of photosensitive silver halide in a photothermographic element according to the invention is within the range of about $1\times10^{-4}$ to about $10^{-1}$ moles of photosensitive silver halide per square meter of support. Other photographic materials can be useful in the described elements according to the invention if desired. Preferred photographic silver halides are silver chloride, silver bromide, silver bromoiodide, silver chlorobromoiodide or mixtures thereof. For purposes of the invention, silver iodide is also considered to be a useful photographic silver halide. Very fine grain photographic silver halide is useful although coarse or fine grain photographic silver halide can be used if desired. The photographic silver halide can be prepared by any of the procedures known in the photographic art, especially those procedures which involve the preparation of photographic silver halide gelatino emulsions. Useful procedures and forms of photographic silver halide for purposes of the invention are described, for example, in the *Product Licensing Index,* Volume 92, December 1971, publication 9232 on page 107, published by Industrial Opportunities Ltd., Homewell, Havant, Hampshire, P09 1EF, UK. The silver halide compositions described in *Research Disclosure,* Vol. 148, August 1976, Item 14879 of Rosenfeld and *Research Disclosure,* September 1974, pages 43–45 are further examples of useful silver halide materials. The photographic silver halide as described can be unwashed or washed, can be chemically sensitized using chemical sensitization procedures known in the art, can be protected against the production of fog and stabilized against the loss of sensitivity during keeping as described in the above *Product Licensing Index* publication and in *Research Disclosure,* Vol. 170, June 1978, Item 17029, of J. W. Carpenter and P. W. Lauf.

A variety of non-silver photosensitive components can be useful with the described photothermographic elements. These can be, for instance, photosensitive diazo imaging materials, imaging materials based on photoreductants, photosensitive dyes and the like. The term "photoreductant" or "photoreductants" as used herein is intended to mean a material capable of molecular photolysis or photoinduced rearrangement to generate a reducing agent capable of reducing an imaging agent, or a reducing agent precursor which can be converted to such a reducing agent. Useful non-silver photosensitive components are described, for example, in *Research Disclosure,* October 1974, Item 12617, pages 12–30, the description of which is incorporated herein by reference. The non-silver photosensitive components can include combinations of such components, if desired. An example of a non-silver photosensitive material comprises a quinone photoreductant, such as 2-isopropoxy-1,4-naphthoquinone, with a cobalt amine complex, such as hexa-amine cobalt (III) acetate, as described in the above *Research Disclosure.*

Especially useful photosensitive materials are those designed for microimaging purposes.

The described photothermographic element can comprise a variety of reducing agents, especially organic reducing agents which are typically photographic silver halide developing agents. These reducing agents can be useful in combination. Reducing agents which are especially useful are silver halide developing agents including polyhydroxybenzenes, such as hydroquinone, alkyl-substituted hydroquinones, including tertiary-butyl hydroquinone, methyl hydroquinone, 2,5-dimethyl hydroquinone, and 2,6-dimethyl hydroquinone; catechol and pyrogallol developing agents; chloro-substituted hydroquinone such as chlorohydroquinone or dichlorohydroquinone; alkoxy-substituted hydroquinones such as methoxy hydroquinone or ethoxy hydroquinone; aminophenol reducing agents such as 2,4-diaminophenols and methylaminophenols; ascorbic acid developing agents such as ascorbic acid, ascorbic acid ketals and ascorbic acid derivatives; hydroxylamine reducing agents; 3-pyrazolidone reducing agents such as 1-phenyl-3-pyrazolidone and 4-methyl-4-hydroxymethyl-1-phenyl-3-pyrazolidone; reductone reducing agents, such as 2-hydroxy-5-methyl-3-piperidino-2-cyclopentanone; gallic acid ester reducing agents such as methyl gallate, sulfonamidophenol reducing agents such as the sulfonamidophenol reducing agents described in *Research Disclosure,* January 1973, pages 16–21, published by Industrial Opportunities Ltd., Homewell, Havant, Hampshire, PO9 1EF, UK; phenylenediamine silver halide developing agents such as paraphenylenediamine and the like. Especially useful photothermographic elements can contain combinations of reducing agents as described.

The optimum concentration of reducing agent can be determined based upon such factors as the desired image, other components in the heat developable material, processing conditions and the like.

The term "reducing agent" as employed herein is intended to include reducing agent precursors as well as reducing agents. That is, the reducing agent precursors are intended to include compounds which form a reducing agent upon heating or exposure to some other condition at the desired time.

The photothermographic elements according to the invention can contain an image toner or toning agent in order to provide a more neutral or black tone image upon processing. The optimum image toner or toning agent will depend upon such factors as the particular imaging material, the desired image, particular processing conditions and the like. In some cases certain image toning agents or toners provide much better results with certain imaging materials than with others. Combinations of toning agents or toners can be useful if desired.

The optimum concentration of toning agent or toning agent combination will depend upon such factors as the particular imaging material, processing conditions, desired image and the like.

It is often useful to include a melt-forming compound or melt former in the photothermographic element according to the invention, such as in the imaging layers and in the antihalation layer or filter layer, as described. Combinations of melt-forming compounds or melt-formers can also be useful if desired. The term "melt-forming compound" or "melt former" as employed herein is intended to mean a compound which upon heating to the described processing temperature provides an improved reaction medium, typically a molten medium, wherein the described reaction combination can provide a better image. The exact nature of the reaction medium at processing temperatures described is not fully understood; however, it is believed that at reaction temperatures a melt occurs which permits the reaction components to better interact. Useful melt-forming compounds are typically separate components from the reaction combination, although the reaction combination can enter into the melt formation. Typically useful melt-forming compounds are amides, imides, cyclic ureas and triazoles which are compatible with other of the components of the materials of the invention. Useful melt-forming compounds or melt formers are described, for example, in *Research Disclosure,* Vol. 150, October 1976, Item 15049 of LaRossa and Boettcher, published by Industrial Opportunities Ltd., Homewell, Havant, Hampshire, PO9 1EF, UK. As described, the antihalation or filter layers of the invention can comprise a melt-forming compound if desired.

A range of concentration of melt-forming compound or melt-forming compound combination is useful in the heat developable photographic materials described. The optimum concentration of melt-forming compound will depend upon such factors as the particular imaging material, desired image, processing conditions and the like.

Spectral sensitizing dyes or dye combinations are useful in the described imaging elements and compositions of the invention to confer additional sensitivity to the elements and compositions. Useful sensitizing dyes are described, for example, in the mentioned *Product Licensing Index,* publication 9232, and in *Research Disclosure,* Vol. 170, June 1978, Item 17029.

The photothermographic element according to the invention can also have a range of pAg. The pAg can be measured using conventional calomel and Ag-AgCl electrodes, connected to an Orion digital pH meter. The typical pAg in a photothermographic element according to the invention is within the range of about 2 to about 13. The optimum pAg will depend upon the particular photosensitive component, the desired image, processing conditions and the like.

The photothermographic element according to the invention typically has a pH range which is on the acid side of neutral, that is a pH of less than about 7. Typically useful pH for a photothermographic element according to the invention is within the range of about 2 to about 6, preferably within the range of about 3.5 to about 5.0 The combination of the described biimidazole and dye is also useful on the acid side of neutral, that is a pH of less than about 7.

It is often desirable to have a stabilizer or stabilizer precursor in the described photothermographic element according to the invention to improve post-processing image stability. In some cases the photothermographic element may be sufficiently stable in the absence of a separate stabilizer or stabilizer precursor. However, in many cases in which photographic silver halide is used as the photosensitive material it can be desirable to stabilize the silver halide after processing in order to avoid undesirable post-processing printout. A variety of stabilizer or stabilizer precursors is useful in a photothermographic element as described. The stabilizers or stabilizer precursors can be used alone or in combination if desired. Typically useful stabilizers or stabilizer precursors are sulfur-containing compounds which form a stable silver mercaptide upon heating in the photothermographic element. Useful stabilizers or stabilizer precursors include, for instance, those described in Belgian Pat. No. 768,071 issued July 30, 1971. Photolytically activated polyhalogenated organic compounds can be useful if desired. Such photolytically activated polyhalogenated organic compounds are described, for example, in U.S. Pat. No. 3,874,946 of Costa et al, issued Apr. 1, 1975 and U.S. Pat. No. 3,707,377 of Tiers et al, issued Dec. 28, 1972.

A range of concentration of stabilizer or stabilizer precursor or a combination of these compounds can be useful in the described photothermographic elements. An optimum concentration of stabilizer or stabilizer precursor or combination of these compounds will depend upon such factors as the particular imaging material, processing conditions, desired stability and the like.

A development activator, also known as an alkali-release agent,base-release agent or an activator precursor can be useful in the described photothermographic element of the invention. A development activator, as described herein, is intended to mean an agent or a compound which aids the developing agent at processing temperatures to develop a latent image in the imaging material. Useful development activators or activator precursors are described, for example, in Belgian Pat. No. 709,967 published Feb. 29, 1968, and *Research Disclosure,* Volume 155, Mar. 1977, Item 15567, published by Industrial Opportunities Ltd., Homewell, Havant, Hampshire, PO9 1EF, UK. Examples of useful activator precursors include guanidinium compounds such as guanidinium trichloroacetate, diguanidinium glutarate, succinate, malonate and the like; quaternary ammonium malonates; amino acids, such as 6-aminocaproic acid and glycine; and 2-carboxycarboxamide activator precursors.

It is useful in some cases to have an overcoat layer on the photothermographic element, such as on the imaging layer and/or the antihalation or filter layer according to the invention. An overcoat layer can help reduce fingerprinting and abrasion marks and provide other advantages. The overcoat layer can be one or more of the described polymers which are also useful as binders. However, other polymeric materials which are compatible with the imaging layer of the element of the invention and which can tolerate the processing temperatures employed can be useful. Such other binders or polymeric materials include, for instance, cellulose acetate and polyvinyl chloride. Combinations of polymeric materials can be useful for overcoat purposes if desired.

The photothermographic element according to the invention, especially a silver halide photothermographic element, can contain other addenda such as development modifiers that function as speed-increasing compounds, hardeners, plasticizers and lubricants, coating aids, brighteners, antistatic materials or layers, antifoggants and the like. These are described, for example, in the *Product Licensing Index,* publication 9232, and in *Research Disclosure,* Item 17029, mentioned above.

The photothermographic elements according to the invention can comprise a variety of supports which can tolerate the temperatures useful for processing. Typical supports include cellulose ester film, poly(vinyl acetal) film, poly(ethylene terephthalate) film, polycarbonate film and polyester film supports as described in U.S. Pat. No. 3,634,089 of Hamb, issued July 11, 1972 and U.S. Pat. No. 3,725,070 of Hamb et al, issued Apr. 3, 1973. Related film and resinous support materials, as well as glass, paper, metal and the like supports which can withstand the processing temperatures described and which can be useful with the described filter and antihalation layers are also useful. Typically, a flexible film support is most useful.

The antihalation materials comprising the combination of the described dye, especially the formazan dye, with the hexaarylbiimidazole compound can be present in a suitable transparent support which permits the desired reaction between the described dye and hexaarylbiimidazole.

The antihalation and filter components according to the invention as well as the other compositions described can be coated on a suitable support by various coating procedures known in the photographic art including dip coating, airknife coating, curtain coating or extrusion coating using hoppers, such as described in U.S. Pat. No. 2,681,294 of Beguin, issued June 15, 1954. If desired, two or more layers can be coated simultaneously such as described in U.S. Pat. No. 2,761,791 of Russell, issued Sept. 4, 1956 and British Pat. No. 837,095 published June 9, 1960.

The antihalation or filter layer according to the invention should comprise binders which adhere suitably to the support or other layer of the photothermographic element upon which the antihalation or filter layer is coated. Selection of optimum binders for adhesion purposes will depend upon such factors as the particular support, processing conditions, the particular photosensitive layer, and the like.

While a variety of components can be useful in a described antihalation layer according to the invention, it is often desirable to have a combination that becomes at least 90% colorless within about 30 seconds upon heating the element to a temperature of at least about 120° C. This combination can be useful in a photothermographic element as described.

In some cases it is useful to have a small concentration, typically up to about 6 milligrams, of 1-naphthoic acid per square foot of support in the combination containing the biimidazole compound. The presence of the 1-naphthoic acid provides the advantage of reducing undesired release of volatile materials from the combination containing the biimidazole compound. Other acids that are useful include 2-naphthoic and benzoic acids. Selection of a suitable binder can influence the desirability of the addition of a separate acid compound.

An especially useful embodiment of the invention is a photothermographic element comprising (a) a support having thereon (b) a photothermographic layer, and on the support or in the support (c) at least one antihalation component comprising, in a polymeric binder, in reactive association, (i) at least one compound represented by the formula (I), as described, with (ii) at least one formazan antihalation dye, wherein the antihalation component becomes at least about 90% colorless within about 30 seconds upon heating to a temperature of at least about 120° C.

Another especially useful embodiment of the invention is a photothermographic element comprising (a) a support, having thereon (b) a photothermographic layer and, on the support or in the support, (c) an antihalation or filter component wherein the element comprises, as (c), in a polymeric binder consisting essentially of a maleic anhydride-styrene copolymer, in reactive association, (i) an oxidative dimer of triphenylimidazole and (ii) a metallized formazan dye consisting essentially of a complex of zinc chloride with a formazan dye represented by the formula:

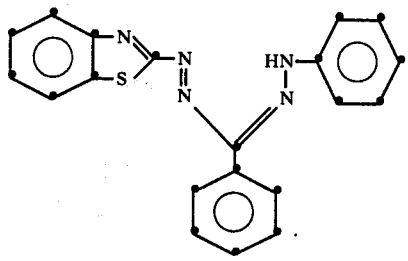

wherein (c) becomes at least 90% colorless within about 30 seconds upon heating to a temperature of at least 120° C.

A further especially useful embodiment of the invention is a photothermographic element comprising (a) a support, having thereon, (b) a photothermographic layer and, on the support or in the support, (c) an antihalation or filter component, wherein the element comprises, as (c), in a polymeric binder consisting essentially of poly(methyl methacrylate), in reactive association, (i) an oxidative dimer of triphenylimidazole with (ii) a formazan dye represented by the formula:

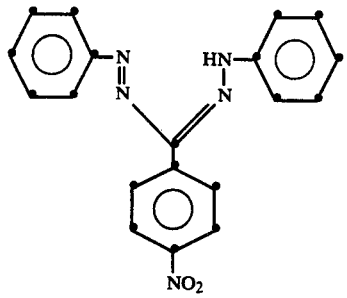

wherein (c) becomes at least 90% colorless within about 30 seconds upon heating to a temperature of at least 120° C.

A variety of imagewise exposure means are useful for imaging according to the invention. The elements according to the invention are typically sensitive to the ultraviolet and blue regions of the spectrum and exposure means which provide this radiation are preferred. Typically, however, if a spectral sensitizing dye is employed in the described photothermographic element, exposure means using other ranges of the electromagnetic spectrum can be useful. Typically a photothermographic element according to the invention is exposed imagewise with a visible light source such as a tungsten lamp to provide a developable image, although other sources of radiation are useful such as lasers, electron beams and the like.

A visible image can be developed in a photothermographic element according to the invention within a short time after imagewise exposure merely by uniformly heating the photothermographic element to moderately elevated temperatures. For example, the photothermographic element can be heated, after imagewise exposure, to a temperature within the range which provides development of the latent image and also provides the necessary temperature to cause the antihalation or filter layer to change from colored to colorless. This temperature is within the range of about 90° C. to about 250° C., such as within the range of about 110° C. to about 200° C. Heating is typically carried out until a desired image is developed and until the antihalation or filter layer is bleached to a desired degree. This heating time is typically a time within about 1 second to about 20 minutes, such as about 1 second to about 90 seconds. The photothermographic element according to the invention is typically heated to a temperature within the range of about 90° C. to about 250° C. for about 1 second to about 20 minutes.

Another embodiment of the invention is a process of (a) developing an image in an exposed photothermographic element as described and (b) changing the antihalation component in the described element from colored to at least 40%, and preferably at least 90%, colorless comprising heating the element to a temperature of at least about 90° C. until the image is developed and the antihalation component is changed from colored to at least 40%, and preferably at least 90%, colorless.

The photothermographic element according to the invention can be useful for forming a negative or a positive image. The formation of a negative or positive image can depend, for example, primarily upon the selection of the particular photosensitive silver halide. One class of useful photosensitive silver halide materials is the class of direct positive photographic silver halide materials designed to produce positive images.

Processing according to the invention is usually carried out under ambient conditions of pressure and humidity. Pressures and humidity outside normal atmospheric conditions can be employed if desired; however, normal atmospheric conditions are preferred.

A variety of heating means can be useful to provide the necessary heating of the described photothermographic element according to the invention. The heating means can be a simple hot plate, iron, roller, infrared heating means or the like.

Although it is often undesirable, due to the lack of control in preparation, the described photosensitive silver halide can be prepared in situ in the described material according to the invention. Such a method of preparation of photographic silver halide in situ is described, for example, in U.S. Pat. No. 3,457,075 of Morgan et al, issued July 22, 1969.

Due to the limited solubility of some compounds, it is often desirable to use organic solvents to aid in preparation of the materials for coating to provide an element according to the invention. Typical organic solvents which can be useful in preparing a composition for coating as an antihalation layer or filter layer according to the invention include tetrahydrofuran, methylene chloride, acetone and butanol. Mixing of the solvents with the described components according to the invention can be carried out using means known in the photographic art.

Antihalation materials and filter materials according to the invention can be useful with light sensitive diazotype materials, vesicular imaging materials or other non-silver imaging materials as desired.

The following examples are included for a further understanding of the invention.

EXAMPLE 1

The oxidative dimer of 2,4,5-triphenylimidazole, prepared according to the procedure described in the *Journal of Organic Chemistry*, 36, page 2265 (1971), (also known as a lophine dimer) (35 mg) was dissolved in 1 gram of tetrahydrofuran. To the resulting composition was added 2 grams of a 20% by weight acetone solution of the polysulfonamide: poly(ethylene-co-1,4-cyclohexylenedimethylene-1-methyl-2,4-benzenedisulfonamide). Seven milligrams of 1,5-diphenyl-3-(para-methoxyphenyl)formazan dye was dissolved in this solution. The resulting dye solution was coated on a poly(ethylene terephthalate) film support at a 6 mil wet coating thickness with a doctor blade coating means. The resulting coating was permitted to dry to provide a heat bleachable element according to the invention. The resulting element bleached rapidly and completely upon heating by contacting the element on a hot metal block at 150° C. for a few seconds. The general measure of the activation enthalpy was made from bleach rates at 90° C. and 112° C. and was approximately 29 kilocalories per mole.

EXAMPLE 2

The procedure of Example 1 was repeated using a methylene chloride solvent in place of tetrahydrofuran. The dye-containing composition was coated at a 2 mil wet coating thickness on a poly(ethylene terephthalate) film support. The dye-containing composition was coated on the support at the following coverage:

| | |
|---|---|
| oxidative dimer of 2,4,5-triphenylimidazole | 4.8 mg/dm$^2$ |
| triphenylformazan dye | 1.1 mg/dm$^2$ |
| binder (as described in the following Table I) | 21.5 mg/dm$^2$ |

The following results were obtained with the noted polymers as described in Table I.

Table I

| Binder Polymer | Absorbance at $\lambda_{max}$ | Absorbance after 10 sec. 160° C. Bleach at $\lambda_{max}$ | at 400 nm |
|---|---|---|---|
| poly(vinylbutyral) | 0.78 | 0.04 | 0.08 |
| poly[4,4'-isopropylidenediphenylene isophthalate-co-terephthalate 50:50)] | 1.60 | 0.08 | 0.11 |

The elements were incubated at 38° C. at 50% relative humidity. The results indicated a minimum loss of dye density and no significant impairment of bleaching even after 3 weeks incubation. Incubated, prebleached samples also showed no color-return after 3 weeks at the described incubation conditions.

EXAMPLE 3

The procedure described in Example 2 was repeated using the described polyester binder with the concentration of the components in the coating as follows:

| | |
|---|---|
| oxidative dimer of 2,4,5-triphenylimidazole | 5.4 mg/dm$^2$ |
| triphenylformazan dye | 3.2 mg/dm$^2$ |
| polyester binder (as described in Example 2) | 21.5 mg/dm$^2$ |
| p-toluenesulfonic acid | 1.1 mg/dm$^2$ |

The coating was heated as described in Example 2. No volatiles were observed to be released from the coating containing the described acid upon heating as described at 160° C. for 10 seconds.

EXAMPLE 4

A tetrahydrofuran formulation was prepared similar to that described in Example 2 with coatings containing:

| | |
|---|---|
| triphenylformazan dye | 1.1 mg/dm$^2$ |
| polysulfonamide binder | 21.5 mg/dm$^2$ |

The mole ratios for the oxidative imidazole dimer were varied between 0.5 moles of dimer per mole of dye and 2.75 moles of dimer per mole of dye in 0.25 mole increments. The results were compared to unbleached coatings. The results indicated that an optimum level for the particular formulation was about 1.6 moles of the described dimer per mole of dye. This provided excellent bleaching properties for the coating when heated for 5 seconds at 160° C. It also provided excellent bleaching properties when the coating was heated at 150° C. for 10 seconds. The bleaching properties of the coating were good at 140° C. when it was heated for 10 seconds but less desirable when the coating was heated at 130° C. for 10 seconds.

EXAMPLE 5

A tetrahydrofuran formulation similar to that described in Example 2 was prepared containing the following:

| | |
|---|---|
| triphenylformazan dye | 1.1 mg/dm$^2$ |
| oxidative imidazole dimer (as described in Example 2) | 3.4 mg/dm$^2$ |

A polysulfonamide binder was mixed with the formulation at concentrations from 50 to 400 mg/ft$^2$ (corresponding to 5.4 to 43.1 mg/dm$^2$) in varying increments.

It was found that after incubating the resulting coatings at 38° C. and 50% relative humidity for 4 weeks that more dye was lost on incubation with lower polymer levels. Upon incubation the polymer coverage of 37.7 mg/dm$^2$ exhibited less than 20% dye loss in 4 weeks and about 10% dye loss in 2 weeks. Changes in formulation may provide different stability correlations.

EXAMPLE 6

A tetrahydrofuran formulation was prepared similar to that described in Example 5 containing the following:

| | |
|---|---|
| triphenylformazan dye | 1.1 mg/dm$^2$ |
| oxidative imidazole dimer | 3.8 mg/dm$^2$ |
| polysulfonamide binder (as described in Example 1) | 32.3 mg/dm$^2$ |

The following acids at coverages of 2.5, 5, 10 and 20 mg/ft$^2$ (corresponding to 0.2, 0.46, 0.93 and 1.87 mg/dm$^2$) were also added to the formulation prior to coating on a support as described in Example 5:

p-toluenesulfonic acid 1-naphthoic acid

After incubation the results demonstrated that low levels (5 mg/ft$^2$) of 1-naphthoic acid appeared to provide less dye loss on incubation, slightly increased processing rate, and did not affect the stain observed after bleaching of the resulting coating. Higher levels of this acid, or use of para-toluenesulfonic acid, produced coatings with properties which were less desirable than a coating which did not contain the incorporated acid.

EXAMPLE 7

A tetrahydrofuran formulation was prepared similar to that described in Example 5 containing the following components:

| | |
|---|---|
| triphenylformazan dye | 1.1 mg/dm$^2$ |
| oxidative imidazole dimer | 5.4 mg/dm$^2$ |
| polymeric binder consisting of copoly(maleimide-styrene) (50:50 parts by weight) (available as Lytron 820 from Monsanto Company, U.S.A) | 21.5 mg/dm$^2$ |

The formulation was coated on a support and then heated. The coating provided clear bleaching to a colorless material with no visible evolution of volatile components.

EXAMPLE 8

This is a comparative example.

Using a tetrahydrofuran formulation similar to that described in Example 5, coatings were prepared containing the following components:

| | |
|---|---|
| triphenylformazan dye | 1.1 mg/dm$^2$ |
| oxidative imidazole dimer (as described below) | 3.2 mg/dm$^2$ |
| polysulfonamide binder (as described in Example 1) | 21.5 mg/dm$^2$ |

The following imidazole dimers were included individually in the above formulation:

2-(ortho-chlorophenyl)-4,5-diphenylimidazole dimer 2-(ortho-methoxyphenyl)-4,5-diphenylimidazole dimer The above formulation was tested with and without p-toluenesulfonic acid as an addenda (at 5 mg/ft$^2$ corresponding to 0.46 mg/dm$^2$).

Upon heat processing of the resulting coating after coating the formulation on a suitable support, minimal bleaching was observed in the coating after heating at 200° C. for 30 seconds.

This indicated that the described imidazole dimers are in the above formulation, too stable toward thermal degradation to be optimally useful at the temperature and time used.

EXAMPLE 9

Certain of the oxidative imidazole dimers have limited solubility in certain solvents. The solubility of certain imidazole dimers is limited to methylenechloride formulations and tetrahydrofuran formulations.

An acetone formulation was prepared by mixing the following components and coating on a transparent poly(ethylene terephthalate) film support:

| | |
|---|---|
| triphenylformazan dye | 1.1 mg/dm$^2$ |
| solubilized imidazole oxidative dimer of: | 4.0 mg/dm$^2$ |

-continued

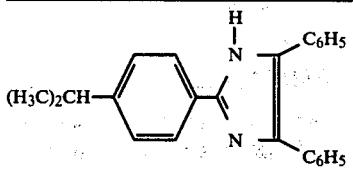

| | |
|---|---|
| polysulfonamide binder (as described in Example 1) | 32.3 mg/dm$^2$ |

After the above formulation was coated on a film support, the coating was permitted to dry and then heat processed by heating the element at 160° C. for 10 seconds. This provided good bleaching of the coating.

The coating before bleaching was incubated 4 weeks at 38° C. and 50% relative humidity. This resulted in a 37.5% loss in dye density with no impairment of bleaching ability at 160° C.

EXAMPLE 10

Additional imidazole dimers were also included in a heat bleachable layer. These were solubilized imidazole oxidative dimers of compounds within the following formula:

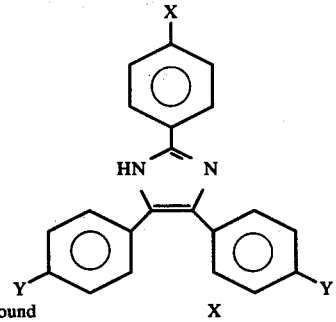

| Compound | X | Y |
|---|---|---|
| 10 A | Isopropyl | H |
| 10 B | H | Isopropyl |
| 10 C | Isopropyl | Isopropyl |
| 10 D | Methyl | H |

Coatings were prepared using tetrahydrofuran as a coating solvent at the following levels of components:

| | |
|---|---|
| oxidative imidazole dimer | 3.7 mg/dm$^2$ |
| triphenylformazan dye | 0.93 mg/dm$^2$ |
| polymeric binder | 28.0 mg/dm$^2$ |

The polymeric binder was either maleic anhydride-styrene copolymer (available as Lytron 820 from Monsanto Company, U.S.A.) or a polysulfonamide binder (poly(ethylene-co-1,4-cyclohexylene-dimethylene-1-methyl-2,4-benzenedisulfonamide)). The coating was permitted to dry to provide an element according to the invention. The formulation was coated at a 2 mil wet coating thickness on a poly(ethylene terephthalate) film support.

Good bleaching properties of the resulting element were observed when the element was heated at 160° for 10 seconds with both polymeric binders and with each of the described imidazole dimers with a minimal stain seen at an absorption of 400 nanometers.

Better incubation stability properties were observed with the maleic anhydride-styrene copolymer as a binder.

EXAMPLE 11

The procedure described in Example 10 was repeated with Compound 10 B with the exception that acetone was used in place of tetrahydrofuran. The dimer was found to have excellent solubility in an acetone formulation.

A coating containing this dimer demonstrated excellent bleaching at 160° C. when heated for 10 seconds.

EXAMPLE 12

The described oxidative, tris-substituted, imidazole dimer (Compound 10 C in Example 10) was also included in a formulation in a similar manner to that described in Example 10 using 0.9 mg/dm$^2$ of triphenylformazan dye and 28 mg/dm$^2$ of the described polymeric binder consisting of maleic anhydride-styrene copolymer. Good bleaching properties were observed when the resulting coating was heated for 10 seconds at 160° C.

Good results were also observed when the described tris-substituted dimer (Compound 10 C) was coated at higher levels.

EXAMPLES 13–16

The following dyes were evaluated:

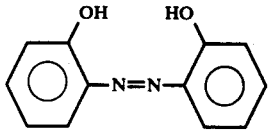

Dye A

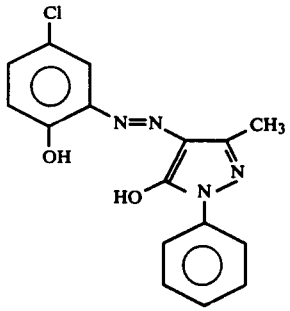

Dye B

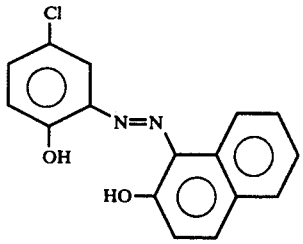

Dye C

-continued

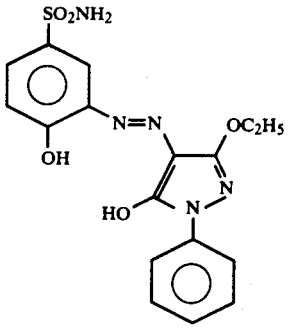

Dye D

METHOD

Stock solution (A): In 7 grams acetone were dissolved 350 mg 2-phenyl-4,5-bis(p-isopropylphenyl-)imidazole dimer.

EXAMPLE 13:

(a) In 0.7 grams stock solution (A) were dissolved 6 mg Dye A (above). To this was added 1.4 grams of 15 weight percent poly(vinyl butyral) (BUTVAR B-76 available from the Monsanto Co., U.S.A.) in 1:1 acetone:2-methoxyethanol. This solution was coated with a 4 mil doctor blade on subbed poly(ethylene terephthalate) film support.

EXAMPLE 14:

(a) was repeated using 10 mg of Dye B, above.

EXAMPLE 15:

(a) was repeated using 9 mg Dye C, above. (A few drops of methyl ethyl ketone were added to help dissolve the dye).

EXAMPLE 16:

(a) was repeated using 12 mg Dye D, above.

The resulting films were heated, face up, on a 150° C. block and the time in seconds to bleach was noted. Diffuse densities were read before and after heat bleaching. The results are given in following Table II.

Table II

| Example No. | Dye | Fresh Density | Bleach Time (Secs.) | Bleached Density |
|---|---|---|---|---|
| 13 | A | 0.39 (Blue) | 20 | 0.23 (Blue) |
| 14 | B | 0.91 (Blue) | 5 | 0.22 (Blue) |
| 15 | C | 0.64 (Green) | 10 | 0.18 (Green) |
| 16 | D | 0.66 (Blue) | 15 | 0.19 (Blue) |

The following oxidative triarylimidazole dimers were tested. All dimers were tested in hand coatings with triphenylformazan dye in a polymeric binder. The compounds were oxidative dimers of:

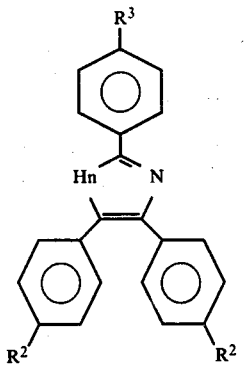

wherein $R^2$ and $R^3$ were as defined in following Table III. All substituents are in the para position unless otherwise indicated in Table III.

Table III

| Example No. | $R^3$ | $R^2$ | Results (10 sec. at 160° C. Bleach) |
|---|---|---|---|
| 17 | H | H | Good Bleaching |
| 18 (comparative example) | o-chloro | H | Minimal Bleaching |
| 19 (comparatiive example) | o-methoxy | H | Minimal Bleaching |
| 20 | isopropyl | H | Good Bleaching |
| 21 | methyl | H | Good Bleaching |
| 22 | H | isopropyl | Good Bleaching |
| 23 | isopropyl | isopropyl | Good Bleaching |
| 24 | methoxy | methoxy | Good Bleaching |
| 25 | H | methoxy | Good Bleaching |
| 26 (comparative example) | o-chloro | methoxy | Minimal Bleaching |
| 27 | (p-methoxy) (o-methoxy) | p-methoxy | Good Bleaching |
| 28 | H | n-butyl | Good Bleaching |
| 29 | n-butyl | isopropyl | Good Bleaching |
| 30 | H | ethyl | Good Bleaching |
| 31 | o-$C_5H_{11}$ | isopropyl | Good Bleaching |

Metal chelates of the described formazan compounds are also useful for the purposes described.

EXAMPLE 32—BLEACHING OF A COMPLEXED FORMAZAN DYE

In 0.4 g of warm 2-methoxyethanol was dissolved 2 mg of cupric acetate monohydrate and 6 mg of triphenylformazan to give a dark purple solution. To this solution was added 1.4 g of a 15% by weight solution of poly(vinyl butyral) (BUTVAR B-76) in 1:1 parts by weight acetone/2-methoxyethanol and a solution of 50 mg of the oxidative bis isopropyl substituted triphenylimidazole dimer, as described, in 0.3 g of 1,2-dichloroethane. The resulting solution was coated at a 4 mil wet coating thickness on a poly(ethylene terephthalate) film support containing a subbing layer. The resulting film had a grey-purple color. A sample of this film having a neutral diffuse density of 0.36 was heated for 5 seconds face-up on a 140° C. hot metal block. This caused bleaching of the coating. The neutral diffuse density of the heated film was 0.09.

EXAMPLE 33

A coating was prepared containing the following materials with a 2 mil doctor blade:

300 mg/ft$^2$ (BUTVAR B-76 (poly(vinyl butyral))
10 mg/ft$^2$ Dye 33A
100 mg/ft$^2$ Bis isopropyl substituted oxidative triphenylimidazole dimer, as described, employing acetone as the solvent.

Dye 33A is represented by the following structure:

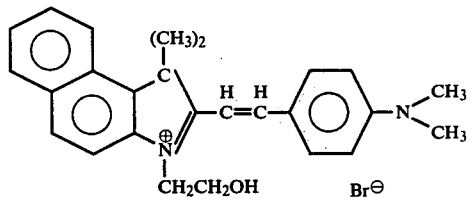

Dye 33A (Polymethine Dye)

Application of heat to this coating (160° C. for 10 seconds) resulted in a bleaching of the dye from a density (at λmax) of 0.360 to 0.105 after bleaching (71% change).

EXAMPLE 34

The procedure described in Example 33 was repeated with the exception that Dye 34B was used in place of Dye 33A.

Dye 34B is represented by the following structure:

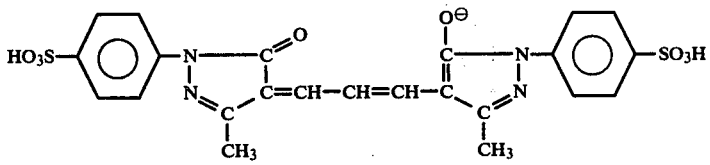

Dye 34B (Oxanol dye)

Application of heat to this coating (160° C. for 10 seconds) resulted in a bleaching (at λmax=540) of 0.42 to a density after bleaching of 0.165 (a 61% density decrease).

EXAMPLE 35—USE OF MELT FORMERS

A series of low melting solids (i.e. melt formers) were added at 100 mg/ft$^2$ (~11 mg/dm$^2$) to the following formulation:

| | mg/ft$^2$ | mg/ft$^2$ |
|---|---|---|
| Triphenylformazan | 10 | 1.1 |
| Bis isopropyl-substituted triphenylimidazole dimer, as described, | 50 | 5.4 |
| LYTRON 820 (available from Monsanto Co., U.S.A.) (Purified Monsanto copoly(maleimide/styrene) 50:50) | 300 | 33 |

The resulting composition was coated at a 2 mil wet coating thickness from acetone solution onto a poly(ethylene terephthalate) film support. A melt former was added to the composition before coating. After drying the coating, it was heated for 5 seconds at 130° C. The results were as follows:

| Melt Former | MP(°C.) | 130° C. - 5 sec. Process |
|---|---|---|
| None (Control) | — | Minimal Bleach |
| Methanesulfonamide | 91–93 | Slight Bleach |
| Methylurea | 99–101 | Good Bleach |
| Resorcinol | 109–110 | Slight Bleach |
| N-Methylbenzamide | 79–82 | Good Bleach |

Methylurea- and N-methylbenzamide-containing coatings can also be processed for 15 seconds at 120° C. to bleach the described dye.

EXAMPLE 36

Coatings were prepared at the same levels as in Example 35 but employing BUTVAR B-76 poly(vinyl butyral)) instead of LYTRON 820. Processing as a hot block for following times and temperatures produced bleaching of the dye:

| Temp. (°C.) | Time (sec.) |
|---|---|
| 150 | 3 |
| 140 | 3 |
| 130 | 5 |
| 120 | 10 |

EXAMPLES 37–47

A series of polymers was tested in a composition as follows:

| | | |
|---|---|---|
| Polymer (see list following) | 300 | 33 |
| Triphenylformazan | 10 | 1.1 |
| Bis isopropyl substituted triphenylimidazole dimer, as described | 50 | 5.4 |

In each instance the coating was heated for 10 seconds at 130° C. The results were as follows:

| Example No. | Polymer | Tg (°C.) | Solvent | Results at 10 Sec. 130° C. Processing |
|---|---|---|---|---|
| 37 | poly(N-phenylmaleimide ethylmethacrylate) (comparative example) | 159 | Methylene Chloride | Minimal Bleach |
| 38 | poly(N-phenylmaleimide methylmethacrylate) 2575 (comparative example) | 155 | Methylene Chloride | Minimal Bleach |
| 39 | poly(N-phenylmaleimide n-butylmethacrylate) | 105 | Methylene Chloride | Good Bleach |
| 40 | poly(2-hydroxyethyl methacrylate) (ELVACITE 2010 a trade name of E. I. duPont Co., U.S.A.) | 100 | Methylene Chloride | " |
| 41 | polystyrene (available from Kopper Chemical Co., U.S.A. as 8X) | 100 | Methylene Chloride | " |
| 42 | poly(N-phenylmaleimide methylmethacrylate) 50/50 | 170 | Methylene Chloride | " |
| 43 | poly(N-phenylmaleimide styrene) 50/50 (comparative example) | 220 | Methylene Chloride | Minimal Bleach |
| 44 | poly(N-diphenylmethylmaleimide methylmethacrylate) 50/50 (comparative example) | 161 | Methylene Chloride | Minimal Bleach |
| 45 | cellulose acetate propionate (comparative example) | — | Acetone | Minimal Bleach |
| 46 | ETHOCEL T (ethyl cellulose, a trade name of Hercules Chemical Co., U.S.A.) | — | " | Good Bleach |
| 47 | BUTVAR B-76 [poly(vinyl butyral) available from Monsanto Chemical Co., U.S.A.] | — | Methylene Chloride | " |

EXAMPLES 48–50 (COMPARATIVE EXAMPLES)

The following dyes were tested in a formulation similar to that described in Example 33 in place of the Dye 33A. In each instance bleaching of the dye was not satisfactory.

EXAMPLE 48 (COMPARATIVE EXAMPLE)

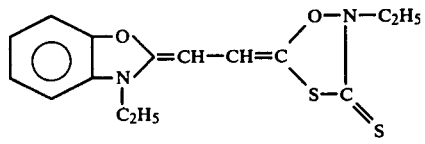

EXAMPLE 49 (COMPARATIVE EXAMPLE)

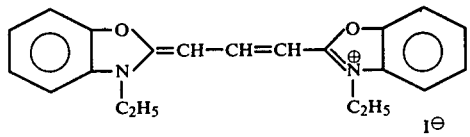

EXAMPLE 50 (COMPARATIVE EXAMPLE)

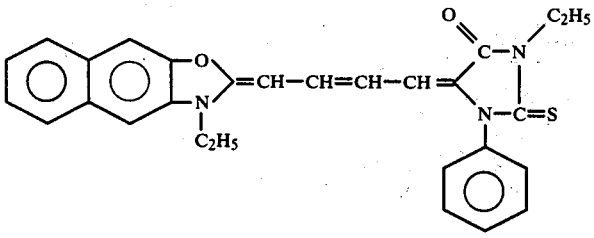

EXAMPLE 51

A photothermographic element was prepared by mixing the following components and coating the resulting composition on a poly(ethylene terephthalate) film support:

- gelatino silver bromoiodide photosensitive emulsion (2.5 mole % I, chemically sensitized) (in organic solvent mixture)
- poly(vinyl butyral) (binder)
- basic alumina (development modifier)
- behenic acid (antifoggant addenda)
- lithium stearate
- silver behenate (oxidizing agent)
- 3-ethyl-2-thio-2,4-oxazolidinedione (speed increasing addenda)
- dimethylpolysiloxane (coating aide)
- 2,6-dichloro-4-benzenesulfonamidophenol (reducing agent)
- 2-(tribromomethylsulfonyl)benzothiazole (stabilizer precursor)

The composition was also spectrally sensitized with a benzoxazylidene thiohydantoin spectral sensitizing dye and a thiazolocarbocyanine spectral sensitizing dye. The concentrations of the components were balanced to provide desired photosensitivity. The resulting photothermographic layer was permitted to dry and then it was overcoated with a cellulose acetate overcoat. The resulting photothermographic element was then coated on the side of the film support opposite the photothermographic layer with an antihalation layer containing the following components as the specified concentrations:

| | mg/929 cm$^2$ (mg/ft$^2$) of support |
|---|---|
| poly(methyl methacrylate) (binder) (mixture of low viscosityy poly(methyl methacrylate) with high viscosity poly(methyl methacrylate)) | 300.0 |
| 1,2'-bis(2,4,5-triphenyl-imidazole) (dimer) | 75.0 |
| 1,5-diphenyl-3-(p-nitrophenyl) formazan (antihalation dye) | 7.5 |

The resulting photothermographic element was imagewise exposed through a line image (opaque 100 μm lines 5 mm apart on a clear background) to produce a developable latent image in the photothermographic layer. The exposure means was a mercury lamp. After imagewise exposure the photothermographic element was heated by contacting the side of the element containing the antihalation layer with a heated metal block for 5 seconds at 130° C. A developed image was produced in the photothermographic layer and the antihalation layer was changed from colored to colorless.

The described procedure was repeated with the exception that the antihalation layer was omitted. The photothermographic element was imagewise exposed and then heated as described. A developed image was produced in the photothermographic layer. However, the sharpness of the developed image was markedly less than the developed image in the photothermographic element containing the antihalation layer according to the invention.

EXAMPLE 52

A poly(ethylene terephthalate) film support was coated with a mixture of the following components:

| | mg/dm$^2$ of support |
|---|---|
| copolymer of maleic anhydride and styrene (binder) (LYTRON 820, a trade name of Monsanto Co., U.S.A.) | 32.4 |
| formazan dye represented by the formula: 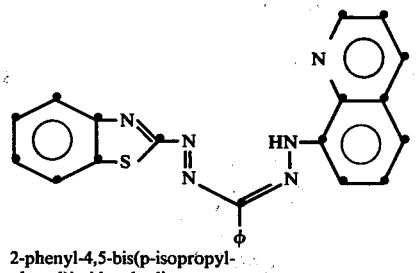 | 1.08 |
| 2-phenyl-4,5-bis(p-isopropyl-phenyl)imidazole dimer | 5.40 |

The coating had a 2 mil wet coating thickness and acetone was added as a solvent to the composition to aide in coating.

The resulting coating prior to heating had a density at 600 nm of 0.465 and a density at 400 nm of 0.210. The coating was then heated by contacting the side of the element opposite the coating with a heated metal block at 160° C. for 10 seconds. The resulting coating, after heating, had a density at 600 nm of 0.015 and a density at 400 nm of 0.175.

EXAMPLE 53

This illustrates preparation of metallized formazan dyes.

A dye solution containing $5\times10^{-5}$ M of dye in a solvent (1:1 parts by volume 3 A alcohol:acetone) (3 A alcohol contained 95:5 parts by volume ethanol:methanol) was prepared for each of the following dyes:

Dye 53A

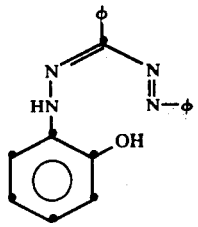

Dye 53B

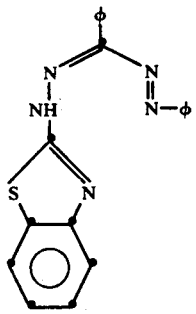

Dye 53C

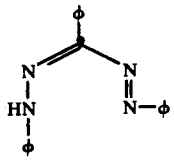

In the above formulas $\phi$ refers to a phenyl group.

A portion of each of the dye solutions was mixed with $5\times10^{-4}$ M concentration of each of the following compounds:

cobaltous nitrate,
zinc chloride,
cupric acetate,
cadmium chloride and
nickel nitrate.

The level of maximum absorption was measured for each resulting composition. The maximum absorption for each is listed in the following Table IV:

Table IV

| Dye | Control (Unmetallized) | $\lambda_{max}$ (nm) Co(II) | Zn(II) | Cu(II) | Cd(II) | Ni(II) |
|---|---|---|---|---|---|---|
| A | 510 | 605 | 510 | 590 | 510 | 510 |
| B | 465 | 610 | 610 | 610 | 610 | 630 |
| C | 485 | 485 | 485 | 550 | 485 | 485 |

The above results from this example illustrate that both the nature of the metal used for metallizing the designated dyes as well as the dyes effect the point (nm) of maximum absorption.

Each of the specified metallized dyes can be mixed with an imidazole dimer as described herein to produce an antihalation composition.

EXAMPLE 54

This illustrates preparation of a dye combination containing a metallized formazan dye.

A solution was prepared by mixing the following:

| Compound | concentration (moles) |
|---|---|
| (a) cadmium chloride | $3\times10^{-5}$ |
| (b) 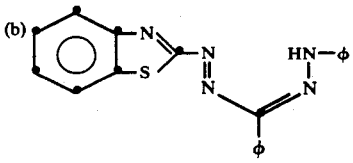 | $2.25\times10^{-5}$ |
| (c) 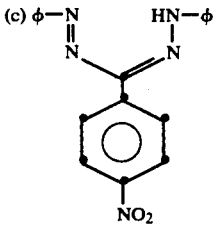 | $4\times10^{-5}$ |

This dye, which does not shift in the presence of Cd(II) ions, was added to fill in the short wavelength region.

The resulting solution had a density in excess of 0.4 beyond 650 nm. The composition was useful for antihalation purposes. The resulting composition can be mixed with an imidazole dimer as described herein to produce an antihalation composition.

EXAMPLE 55

This illustrates use of a metallized formazan dye.

An antihalation coating was prepared by mixing the following with a methylene chloride solvent and coating the resulting composition at a 2 mil wet coating thickness on a poly(ethylene terephthalate) film support.

| | mg/dm$^2$ |
|---|---|
| formazan dye represented by the formula: 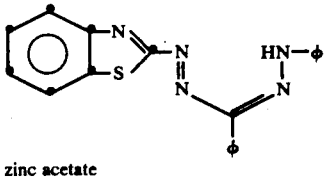 | 1.62 |
| zinc acetate ($Zn(CH_3COO)_2 \cdot 2H_2O$) | 1.99 |
| imidazole dimer (hexaphenylbiimidazole) | 10.8 |
| poly(vinyl butyral) (binder) (BUTVAR B-76, trade name of Monsanto Co., U.S.A.) | 32.4 |
| 1-naphthoic acid | 1.62 |

The resulting antihalation layer was permitted to dry and then was heated by contacting it with a heated metal block at 160° C. for 10 seconds. The antihalation layer was changed from colored to at least 90% colorless with minimal absorption at 400 nm.

The described antihalation layer of this example can be useful as a layer of a photothermographic element as described.

EXAMPLE 56

This illustrates preparation of an antihalation layer with a combination of dyes.

An antihalation coating was prepared by mixing the following with a methylene chloride solvent and coating the resulting composition at a 2 mil wet coating thickness on a poly(ethylene terephthalate) film support:

| | mg/dm$^2$ |
|---|---|
| zinc-formazan dye complex represented by the formula: 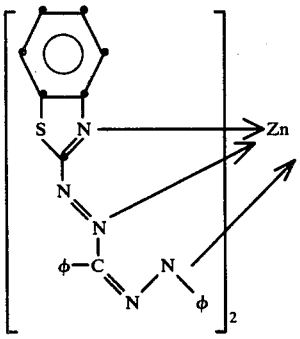 | 1.08 |
| yellow formazan dye represented by the formula: 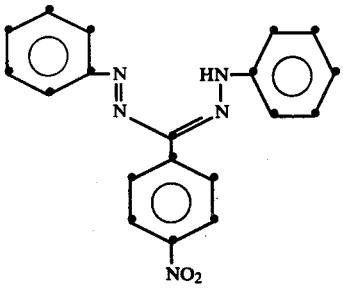 | 0.54 |
| benzthiazoyl substituted formazan dye represented by the formula: 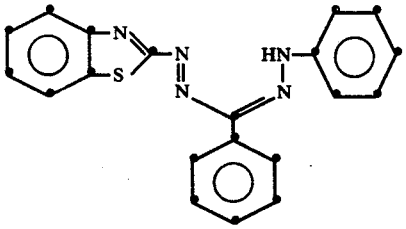 | 0.54 |
| imidazole dimer (hexaphenylbiimidazole) | 10.8 |
| poly(methyl methacrylate) (binder) (ELVACITE 2010, trade name of E. I. duPont Co., U.S.A.) | 32.4 |
| 1-naphthoic acid | 2.16 |

The resulting antihalation coating was permitted to dry and then was heated by contacting the film with a heated metal block at 160° C. for 10 seconds. The maximum absorption density of the antihalation coating before heating was 0.750 at 500 nm. The absorption density of the coating at 500 nm after the described heating step was 0.06.

The antihalation coating as described is useful with a photothermographic element containing a silver halide photothermographic layer that has panchromatic spectral sensitization.

The invention has been described in detail with particular reference to preferred embodiments thereof, but it will be understood that variations and modifications can be effected within the spirit and scope of the invention.

What is claimed is:

1. In a photothermographic element comprising (a) a support, having thereon (b) a photothermographic layer and, on the support or in the support, (c) an antihalation or filter component, the improvement wherein said element comprises, as (c), in reactive association, (i) at least one hexaarylbiimidazole with (ii) at least one antihalation or filter dye that is reactive with the product formed upon heating said hexaarylbiimidazole to a temperature of at least about 90° C., and wherein said antihalation or filter component becomes essentially colorless within about 20 minutes upon heating to a temperature of at least 90° C.

2. A photothermographic element as in claim 1 wherein said (c) comprises, in reactive association, (i) at least one hexaarylbiimidazole with (ii) at least one formazan dye, and wherein said antihalation or filter component becomes at least 90% colorless within about 20 minutes upon heating to a temperature of at least about 90° C.

3. A photothermographic element as in claim 1 wherein said dye consists essentially of a formazan dye represented by the formula:

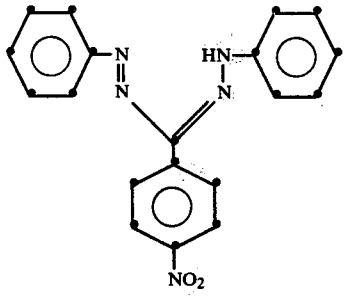

4. A photothermographic element as in claim 1 wherein said dye consists essentially of a metallized formazan dye.

5. A photothermographic element as in claim 1 wherein said dye consists essentially of a zinc-formazan dye complex.

6. A photothermographic element as in claim 1 wherein said dye consists essentially of a zinc-formazan dye complex consisting essentially of a complex of zinc chloride with a formazan dye represented by the formula:

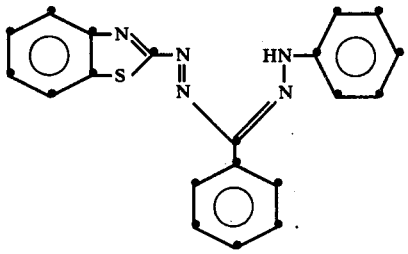

7. A photothermographic element as in claim 1 wherein said dye consists essentially of a cobalt-formazan dye complex consisting essentially of a complex of cobaltous nitrate with a formazan dye represented by the formula:

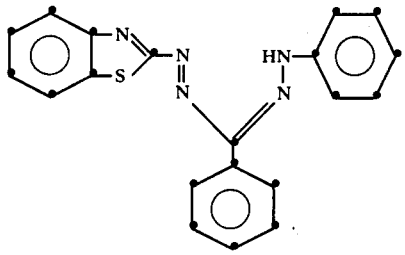

8. A photothermographic element as in claim 1 wherein said dye consists essentially of a copper-formazan dye complex consisting essentially of a complex of cupric acetate with a formazan dye represented by the formula:

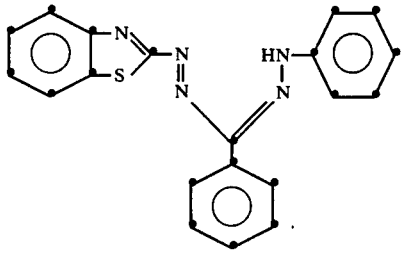

9. A photothermographic element as in claim 1 wherein said (c) becomes at least 90% colorless within 30 seconds upon heating to a temperature of at least 120° C.

10. A photothermographic element as in claim 1 wherein said (c) also comprises a polymeric binder.

11. A photothermographic element as in claim 1 wherein said (c) also comprises a polysulfonamide binder.

12. A photothermographic element as in claim 1 wherein said (c) also comprises a poly(methyl methacrylate) binder.

13. A photothermographic element as in claim 1 wherein said hexaarylbiimidazole consists essentially of an oxidative arylimidazole dimer of a compound represented by the formula:

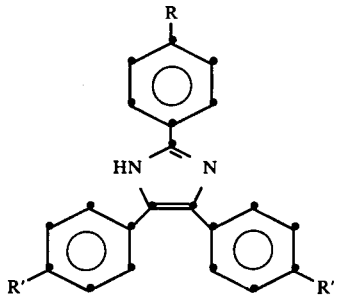

wherein R and R' are individually selected from alkyl containing 1 to 4 carbon atoms and hydrogen.

14. In a photothermographic element comprising (a) a support, having thereon (b) a photothermographic layer and, on the support or in the support, (c) an antihalation or filter component, the improvement wherein said element comprises, as (c), in a polymeric binder consisting essentially of a maleic anhydride-styrene copolymer, in reactive association, (i) an oxidative dimer of triphenylimidazole with (ii) a metallized formazan dye consisting essentially of a complex of zinc chloride with a formazan dye represented by the formula:

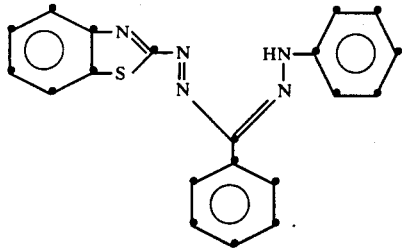

wherein said (c) becomes at least 90% colorless within about 30 seconds upon heating to a temperature of at least 120° C.

15. In a photothermographic element comprising (a) a support, having thereon (b) a photothermographic layer and, on the support or in the support, (c) an antihalation or filter component, the improvement wherein said element comprises, as (c), in a polymeric binder consisting essentially of poly(methyl methacrylate), in reactive association, (i) an oxidative dimer of triphenylimidazole with (ii) a formazan dye represented by the formula:

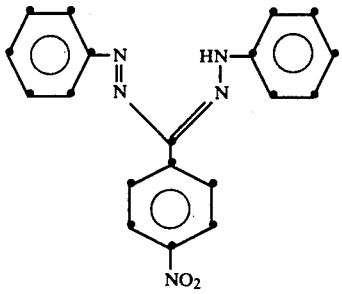

wherein said (c) becomes at least 90% colorless within less than about 30 seconds upon heating to a temperature of at least 120° C.

16. In a photothermographic element comprising (a) a support, having thereon (b) at least one photothermographic layer comprising (1) photosensitive silver halide, with (2) an image-forming combination comprising (i) an organic, silver salt oxidizing agent with (ii) a reducing agent and (3) a polymeric binder, and (c) an antihalation component, the improvement wherein said element comprises, as (c), in a layer on the support, in reactive association, (A) at least one hexaarylbiimidazole with (B) at least one antihalation dye that is reactive with the product formed upon heating said hexaarylbiimidazole to a temperature of at least about 90° C., and wherein said (c) becomes at least about 90% colorless within about 20 minutes upon heating to a temperature of at least about 90° C.

17. A photothermographic element as in claim 16 wherein said antihalation component (c) is an antihalation layer between said support and said layer (b) comprising photosensitive silver halide.

18. A photothermographic element as in claim 16 wherein said antihalation component (c) is an antihalation layer on the side of said support opposite the side containing said layer (b) comprising photosensitive silver halide.

19. A photothermographic element as in claim 16 wherein said antihalation component (c) also comprises up to about 0.021 mg per square centimeter of support of 1-naphthoic acid.

20. A photothermographic element as in claim 16 wherein said element comprises as (c), in a layer on the support, a combination of (A) at least one hexaarylbiimidazole with (B) at least one formazan dye, and wherein said antihalation component becomes at least 90% colorless within about 20 minutes upon heating to a temperature of at least 90° C.

21. A photothermographic element as in claim 16 wherein said dye consists essentially of a formazan dye represented by the formula:

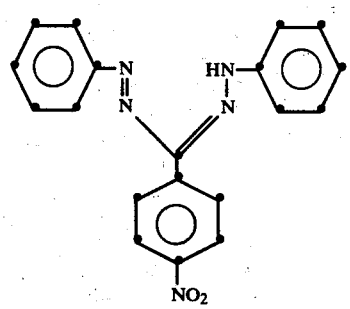

22. A photothermographic element as in claim 16 wherein said dye consists essentially of a metallized formazan dye.

23. A photothermographic element as in claim 16 wherein said dye consists essentially of a zinc-formazan dye complex.

24. A photothermographic element as in claim 16 wherein said dye consists essentially of a complex of zinc chloride with a formazan dye represented by the formula:

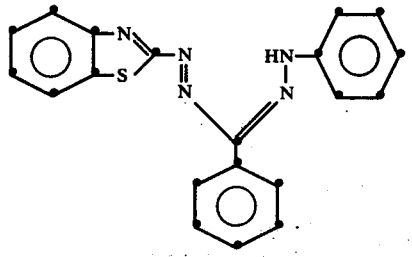

25. A photothermographic element as in claim 16 wherein said dye consists essentially of a cobalt-formazan dye complex consisting essentially of a complex of cobaltous nitrate with a formazan dye represented by the formula:

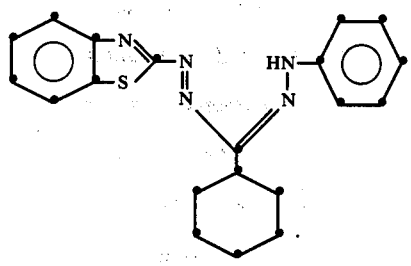

26. A photothermographic element as in claim 16 wherein said dye consists essentially of a copper-formazan dye complex consisting essentially of a complex of cupric acetate with a formazan dye represented by the formula:

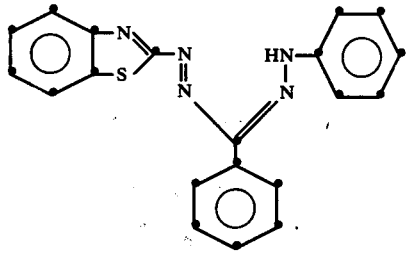

27. A photothermographic element as in claim 16 wherein said (c) becomes at least 90% colorless within 30 seconds upon heating to a temperature of at least 120° C.

28. A photothermographic element as in claim 16 wherein said (c) also comprises a polymeric binder.

29. A photothermographic element as in claim 16 wherein said (c) also comprises a polysulfonamide binder.

30. A photothermographic element as in claim 16 wherein said (c) also comprises a poly(methyl methacrylate) binder.

31. A photothermographic element as in claim 16 wherein said hexaarylbiimidazole consists essentially of an oxidative arylimidazole dimer of a compound represented by the formula:

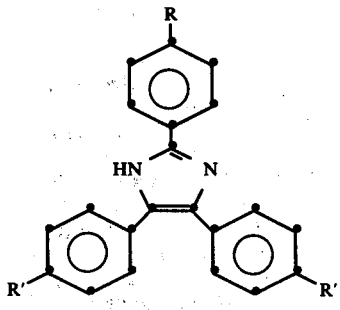

wherein R and R′ are individually selected from alkyl containing 1 to 4 carbon atoms and hydrogen.

32. In a photothermographic element comprising (a) a support, having thereon (b) at least one photothermographic layer comprising (1) photosensitive silver halide, with (2) an image-forming combination comprising (i) an organic, silver salt oxidizing agent consisting essentially of silver behenate with (ii) a phenolic reducing agent and (3) a polymeric binder consisting essentially of poly(vinyl butyral), and (c) an antihalation component, the improvement wherein said element comprises, as (c), in a polymeric binder consisting essentially of a maleic anhydride-styrene copolymer, in reactive association, (A) an oxidative dimer of triphenylimidazole with (B) a metallized formazan dye consisting essentially of a complex of zinc chloride with a formazan dye represented by the formula:

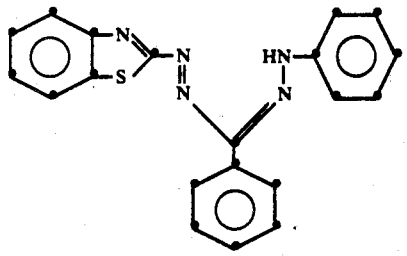

wherein said (c) becomes at least 90% colorless within about 30 seconds upon heating to a temperature of at least 120° C.

33. In a photothermographic element comprising (a) a support, having thereon (b) at least one photothermographic layer comprising (1) photosensitive silver halide, with (2) an image-forming combination comprising (i) an organic, silver salt oxidizing agent consisting essentially of silver behenate with (ii) a phenolic reducing agent and (3) a polymeric binder consisting essentially of poly(vinyl butyral) and (c) an antihalation component, the improvement wherein said element comprises, as (c), in a polymeric binder consisting essentially of poly(methyl methacrylate), in reactive association, (A) an oxidative dimer of triphenylimidazole with (B) a formazan dye represented by the formula:

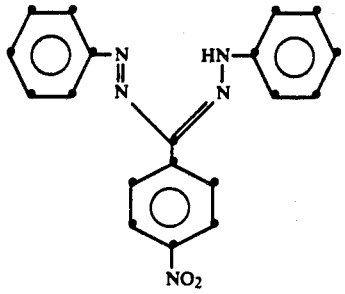

wherein said (c) becomes at least 90% colorless within about 30 seconds upon heating to a temperature of at least 120° C.

34. In a photothermographic element comprising (a) a support having thereon (b) at least one gelatino silver halide photothermographic layer comprising (i) photosensitive silver halide, (ii) a gelatino binder, (iii) a base-release agent, (iv) an image stabilizer precursor, and (v) a silver halide developing agent, and (c) an antihalation layer, the improvement wherein said element comprises, as (c), in reactive association (A) at least one hexaarylbiimidazole with (B) at least one antihalation dye that is reactive with the product formed upon heating said hexaarylbiimidazole to a temperature of at least 90° C. and wherein said antihalation component becomes essentially colorless within 20 minutes upon heating to a temperature of at least 90° C.

35. A photothermographic element as in claim 34 wherein said dye consists essentially of a formazan dye.

36. In a photothermographic element comprising (a) a support having thereon (b) at least one gelatino silver halide photothermographic layer comprising (i) photosensitive silver halide, (ii) a gelatino binder, (iii) a base-release agent, (iv) an image stabilizer precursor, and (v) a silver halide developing agent, and (c) an antihalation layer, the improvement wherein said element comprises, as (c), in a polymeric binder consisting essentially of poly(methyl methacrylate) in reactive association, (A) an oxidative dimer of triphenylimidazole with (B) a formazan dye represented by the formula:

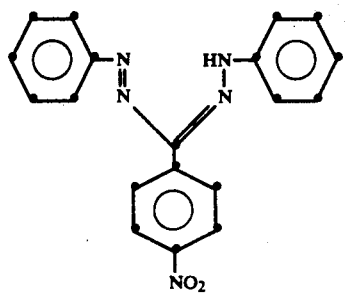

wherein said (c) becomes at least 90% colorless within about 30 seconds upon heating to a temperature of at least 120° C.

* * * * *

UNITED STATES PATENT AND TRADEMARK OFFICE

CERTIFICATE OF CORRECTION

PATENT NO. : 4,196,002

DATED : April 1, 1980

INVENTOR(S) : Steven R. Levinson and Anthony Adin

It is certified that error appears in the above-identified patent and that said Letters Patent are hereby corrected as shown below:

Column 4, line 41, "spectrum" should read ---spectral---.

Column 5, line 16, that part of the formula reading " 3-iodophenylf) " should read --- 3-iodophenyl) ---.

Column 21, line 8, that part of the formula reading " 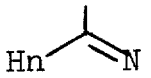 " should read --- 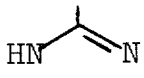 ---.

Columns 23-24, under Example 38, "2575" should read --- 25/75 ---.

Column 23, line 54, "as" should read ---at---.

Column 24, line 1, above "300" insert the heading --- $mg/ft^2$ ---; line 1, above "33" insert the heading --- $mg/dm^2$ ---.

UNITED STATES PATENT AND TRADEMARK OFFICE

CERTIFICATE OF CORRECTION

PATENT NO. : 4,196,002 Page 2 of 2

DATED : April 1, 1980

INVENTOR(S) : Steven R. Levinson and Anthony Adin

It is certified that error appears in the above-identified patent and that said Letters Patent are hereby corrected as shown below:

Column 34, line 10, that part of the formula reading

" 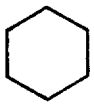 "

should read --- 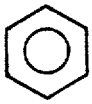 ---.

Signed and Sealed this

Second Day of December 1980

[SEAL]

Attest:

SIDNEY A. DIAMOND

Attesting Officer

Commissioner of Patents and Trademarks